US006879113B2

(12) United States Patent
Nemirow

(10) Patent No.: US 6,879,113 B2
(45) Date of Patent: Apr. 12, 2005

(54) LOW FREQUENCY OUTPUT ELECTRONIC BALLAST

(75) Inventor: Arthur T. Nemirow, Carson City, NV (US)

(73) Assignee: Bruce Industries, Inc., Dayton, NV (US)

( * ) Notice: Subject to any disclaimer, the term of this patent is extended or adjusted under 35 U.S.C. 154(b) by 0 days.

(21) Appl. No.: 10/386,203

(22) Filed: Mar. 11, 2003

(65) Prior Publication Data

US 2004/0178746 A1 Sep. 16, 2004

(51) Int. Cl.[7] ..... H05B 37/02

(52) U.S. Cl. ..... 315/209; 315/224; 315/246; 315/291

(58) Field of Search ..... 315/209, 224, 315/225, 246, 291, 307

(56) References Cited

U.S. PATENT DOCUMENTS

| | | | | |
|---|---|---|---|---|
| 3,700,960 | A | 10/1972 | Lake | |
| 3,967,159 | A | 6/1976 | Dendy et al. | |
| 3,969,652 | A | 7/1976 | Herzog | |
| 3,991,344 | A | 11/1976 | Tabor | |
| 3,999,100 | A | 12/1976 | Dendy et al. | |
| 4,004,188 | A | 1/1977 | Cooper | |
| 4,184,197 | A | 1/1980 | Cuk et al. | 363/16 |
| 4,240,009 | A | 12/1980 | Paul | |
| 4,251,752 | A | 2/1981 | Stolz | |
| 4,277,726 | A | 7/1981 | Burke | |
| 4,358,716 | A | 11/1982 | Cordes et al. | |
| 4,388,563 | A | 6/1983 | Hyltin | |
| 4,392,085 | A | 7/1983 | Knoll et al. | |
| 4,412,154 | A | 10/1983 | Klein | |
| 4,415,839 | A | 11/1983 | Lesea | |
| 4,464,606 | A | 8/1984 | Kane | |
| 4,469,988 | A | 9/1984 | Cronin | |
| 4,477,748 | A | 10/1984 | Grubbs | |
| 4,485,434 | A | 11/1984 | Beeston et al. | |
| 4,504,775 | A | 3/1985 | Becker | |
| 4,523,128 | A | 6/1985 | Stamm et al. | |
| 4,672,522 | A | 6/1987 | Lesea | |
| 4,700,113 | A | 10/1987 | Stupp et al. | |
| 4,723,098 | A | 2/1988 | Grubbs | |
| 4,724,360 | A | 2/1988 | Luursema | |
| 4,870,327 | A | 9/1989 | Jorgensen | 315/307 |
| 4,873,616 | A | 10/1989 | Fredrick et al. | |
| 4,873,617 | A | 10/1989 | Fredrick et al. | |
| 4,949,015 | A | 8/1990 | Nilssen | |
| 4,958,108 | A * | 9/1990 | Jorgensen | 315/307 |
| 5,363,020 | A | 11/1994 | Chen et al. | |
| 5,416,387 | A | 5/1995 | Cuk et al. | 315/209 R |
| 5,428,268 | A | 6/1995 | Melis et al. | 315/247 |

(Continued)

OTHER PUBLICATIONS

Mammano, Robert, Switching Power Supply Topology Voltage Mode vs. Current Mode, Unitrode Design Note, DN–62, 10/94. pp. 1–4.

(Continued)

*Primary Examiner*—Tuyet Thi Vo
(74) *Attorney, Agent, or Firm*—Brooks Kushman P.C.

(57) ABSTRACT

A ballast for an arc discharge lamp load switches high voltage DC at a high frequency based on a low frequency control signal. The switched high voltage is then filtered to remove effects of the high frequency switching. Switching may be accomplished with a high voltage, AC voltage controlled current source generating a high frequency, high voltage substantially rectangular signal at a source output by switching the high voltage DC signal with the low frequency time varying reference signal.

21 Claims, 8 Drawing Sheets

U.S. PATENT DOCUMENTS

| | | | | |
|---|---|---|---|---|
| 5,449,981 | A | 9/1995 | Auld, Jr. et al. | 315/308 |
| 5,483,127 | A | 1/1996 | Widmayer et al. | |
| 5,698,952 | A | 12/1997 | Stebbins | |
| 5,814,976 | A | 9/1998 | Allison | 323/224 |
| 5,969,484 | A | 10/1999 | Santi et al. | 315/247 |
| 6,680,582 | B1 * | 1/2004 | Cammack | 315/224 |
| 2002/0113559 | A1 | 8/2002 | Lam | |
| 2002/0135320 | A1 * | 9/2002 | Kominami et al. | 315/224 |
| 2002/0153849 | A1 * | 10/2002 | Ribarich | 315/247 |
| 2003/0222713 | A1 * | 12/2003 | Skinner et al. | 330/251 |

OTHER PUBLICATIONS

UNITRODE Advanced Regulating Pulse Width Modulators, SLUS181A–Nov. 1999, pp. 1–7.

UNITRODE Current Mode PWM Controller, 4/97 pp. 1–8.

UNITRODE Regulating Pulse Width Modulators, 2/96, pp. 1–8.

UNITRODE Application Note U–102, UC1637/2637/3637 Switched Mode Controller for DC Motor Drive, pp. 3–67–3–78.

UNITRODE Application Note U–100A, UC3842/3/4/5 Provides Low–Cost Current–Mode Control, pp. 3–53–3–66.

Constant Current/Constant Power Regulation Circuits for TOPSwitch® Design Note DN–14, Jun. 1996, pp. 1–16.

TOP242–250 TOPSswitch®–GX Family, Extended Power, Design Flexible, EcoSmart®, Integerated Off–Line Switcher, Sep. 2002, pp. 1–52.

Claudio Adragna, L655561, Enhanced Transition Mode Power Factor Connector, AN 966 Application Note, Jan. 2003, pp. 1–21.

A High Precision PWM Transconductance Amplifier for Microstepping Using Unitrode's UC3637, Unitrode Application Note U–112, pp. 3–124–3–131.

David Zendzian, Class–D Audio Amplifer, Unitrode, pp. 1–7.

Advanced PWM Motor Controller, Unitrode Products From Texas Instruments, UC2638, UC3638, SLUS290A, Jan. 1998, Revised Jan. 2003, pp. 1–8.

TOP232–234 TOPSWITCH®–FX Family, Design Flexible, EcoSmart®, Integrated Off–Line Switcher, Power Integrations, Jan. 2000, pp. 1–36.

* cited by examiner

+5V
C6 1UF
R4 2.21K
R3 2.21K
D1
VDD TMR0 MCLR
VREF
RB4
RB0
RB1
RB2
RB5
RB6
RB7
RB3
AN1
OSC2
OSC1
AN2
AN0
VSS
R7 10.0
R8 100K
Q2
200
Y1
R14 43.2K
R20 10K
C19 .1UF
R17 10.0K
194
190
192
D4
R22 20.0K
R23 2.31K
40
38
196
U4B
R27 182
C21 1UF
R30 4.75K
R28 3.32K
R21 4.75K
R13 4.75K
+15V
C12 10UF
R29 16.2K
C24 .01uF
C13 .1UF
198
C18 1UF
U4A
R24 100
C22 .1UF
36

LOW FREQUENCY OUTPUT ELECTRONIC BALLAST

BACKGROUND OF THE INVENTION

1. Field of the Invention

The present invention relates to electronic ballasts for powering arc discharge lamps.

2. Background Art

Arc discharge lamps, such as fluorescent tube lamps, are powered by ballasts which limit and otherwise control current to the lamps. Current limiting is necessary because the lamp load appears as a negative impedance to the source causing the lamp to draw an increasing current until either the power supply or the lamp is destroyed. Magnetic ballasts place an inductor in series with the lamp load to limit current. Magnetic ballasts find wide use due to their low cost and reliability. However, magnetic ballasts are bulky, electrically inefficient, prone to emit audible noise, must be selected for a particular lamp load and are not readily dimmable.

Electronic ballasts have been developed to alleviate some of the shortcomings associated with magnetic ballasts. In one type of electronic ballast, AC line voltage is rectified, boosted and commutated to generate a high voltage sinusoidal signal at the same frequency as the line voltage. One difficulty with such designs is that the lamp load voltage must have the same frequency as the line voltage. Another difficulty is that any imperfection in the line voltage waveform is amplified and passed to the lamp load.

Preferably, an electronic ballast should satisfy several, sometimes conflicting, requirements. The electronic ballast should function as a universal ballast. This means that the ballast can drive a wide range of lamp loads. Universal ballasts reduce the need for a multitude of ballast designs, each limited to a specific lamp load.

The electronic ballast should control the AC current supplied to the lamp load. Preferably, the electronic ballast should sense the actual current flowing through the load. This provides increased accuracy in current control, extending lamp life.

In many applications, continuous dimming of the lamp load is desirable. Continuous dimming allows the end user the ability to control the full range of luminous output from the lamp load.

In many electronic ballasts, switching is used in one or more stages. Preferably, this switching will occur at a frequency far enough from the load voltage frequency that effects of switching may be filtered from the lamp power signal. In addition, steps must be taken to ensure that the electronic ballast will not emit electromagnetic interference (EMI) that may affect neighboring devices.

Typically, electronic ballasts generate a balanced AC power signal for the lamp load. Studies have shown, however, that a small amount of DC voltage added to the lamp power signal may prevent flickering during lamp dimming. Therefore, an electronic ballast should have the ability to add a DC voltage to the high voltage AC lamp supply signal.

Electronically ballasted lamps typically appear as an inductive load to the power grid. In installations with many such arc discharge lamps or other inductive loads, it is preferable to correct the lamp power factor so that the lamp load appears more resistive.

Arc discharge lamps are sensitive to spikes in supply voltage. Such spikes or peakedness may shorten the lamp life. The lamp crest factor expresses the ratio of peak voltage to RMS voltage supplied to the lamp. An electronic ballast should maintain the crest value within specified limits. Preferably, lamp crest value control should be separate from power factor control since improvements in one tend to degrade the other.

An electronic ballast should be easily adaptable to a wide range of AC power supplies. Examples of AC supplies include the following: 115 VAC±10%, 400 Hz aircraft line power; 85–265 VAC, 47–66 Hz universal mains; 277 VAC, 47–66 Hz industrial power; 120 VAC, 60 Hz U.S. residential power; 380–800 Hz aircraft wild frequency generator power, and the like.

In addition to these requirements, the electronic ballast should be small, light weight, inexpensive and reliable. The design should pay particular attention to the use of magnetics which can add significant size and weight.

SUMMARY OF THE INVENTION

The present invention switches high voltage DC at a high frequency based on a low frequency control signal. The switched high voltage is then filtered to remove effects of the high frequency switching.

An electronic ballast for powering an arc discharge lamp load is provided. A power supply generates a high voltage DC signal. A high voltage, AC voltage controlled current source generates a high frequency, high voltage substantially rectangular signal at a source output by switching the high voltage DC based on a low frequency time varying reference signal. A low pass filter interconnects the source output and the lamp load. The low pass filter has a cutoff frequency between the high frequency and the low frequency. The low pass filter outputs high voltage at the low frequency for driving the arc discharge lamp load.

In an embodiment of the present invention, the high voltage, AC voltage controlled current source includes a bridge switching circuit having a first leg and a second leg. Each leg has two switches in series. The low pass filter connects between the first leg and the second leg at a point on each leg between the switches. At least one current sensor generates a current signal proportional to the current in the first leg and the second leg. A pulse width modulator generates switching signals for each switch in the bridge based on the reference signal and the current signals. The pulse width modulator may generate switching signals to switch the high voltage DC signal through a first switch in the first leg, the lamp load, and a second switch in the second leg during a first switching phase and to switch the high voltage DC signal through a first switch in the second leg, the lamp load and a second switch in the first leg during a second switching phase. The pulse width modulator may include an error amplifier with compensating feedback amplifying a difference between the current signals and the reference signal. The low pass filter may include at least one inductive element between the lamp load and the first leg and at least one inductive element between the lamp load and the second leg.

In another embodiment of the present invention, variations in amplitude of the low frequency time varying reference signal cause corresponding variations in light intensity of the lamp load.

A further embodiment of the present invention includes a signal generator for generating the low frequency time varying reference signal. Alternatively, the low frequency time varying reference signal may be based on an alternating line voltage supplying power to the DC power supply.

In a still further embodiment of the present invention, the low frequency time varying reference signal modulates a high frequency switching signal to generate the high frequency, high voltage substantially rectangular signal.

A method for powering an arc discharge lamp load is also provided. A high voltage DC signal is generated. A low frequency alternating reference signal is received. A high frequency switching signal is generated by modulating the low frequency alternating reference signal. The high voltage DC signal is switched using the high frequency switching signal. An output signal is generated by attenuating components of the switched high voltage DC signal introduced by the high frequency switching signal without substantially attenuating components of the switched high voltage DC signal introduced by the low frequency alternating reference signal. The output signal is supplied to the arc discharge lamp load.

A lighting system is also provided. A DC source provides DC power through a first DC connection and a second DC connection. A first switching element is connected between the first DC connection and a first bridge output. A second switching element is connected between the first bridge output and the second DC connection. A third switching element is connected between the first DC connection and the second bridge output. A fourth switching element is connected between the second bridge output and the second DC connection. A controller generates control signals for the first, second, third and fourth switching elements including high frequency switching pulses modulated by a low frequency reference signal. A four port output filter has a first input port connected to the first bridge output and a second input port connected to the second bridge output. The filter removes components resulting from the high frequency switching pulses while passing components resulting from the low frequency reference signal. At least one arc discharge lamp is connected to output ports of the output filter.

The above objects and other objects, features, and advantages of the present invention are readily apparent from the following detailed description of the preferred embodiments when taken in connection with the accompanying drawings.

DETAILED DESCRIPTION OF THE PREFERRED EMBODIMENT(S)

Figure 1:
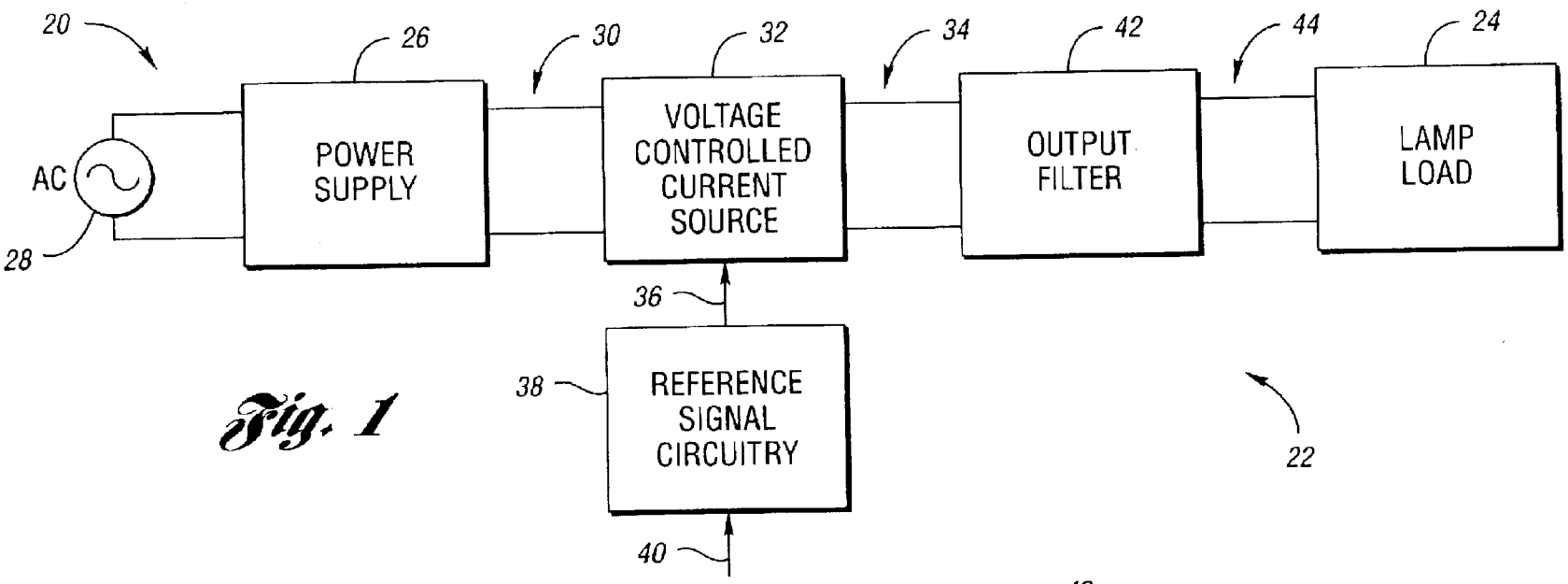
FIG. 1 is a block diagram illustrating a lighting system according to an embodiment of the present invention.

Referring to FIG. 1, a block diagram illustrating a lighting system according to an embodiment of the present invention is shown. A lighting system, shown generally by 20, includes ballast 22 driving lamp load 24. Lamp load 24 may include one or more arc discharge lamps such as, for example, flourescent tubes. Ballast 22 includes power supply 26 receiving alternating line voltage from AC supply 28. Power supply 26 generates substantially ripple free DC high voltage at 30. Voltage controlled current source 32 generates high voltage pulse signal 34 by switching DC high voltage 30 at a high frequency based on low frequency reference signal 36. High voltage pulse signal 34 comprises a sequence of substantially rectangular pulses modulated by reference signal 36. Reference signal 36 is generated by reference signal circuitry 38 preferably based on dimming input 40. Reference signal circuitry 38 may derive reference signal 36 from AC line voltage 28 or, preferably, may generate reference signal 36 independent of AC supply 28. Output filter 42 receives high voltage pulse signal 34 and attenuates high frequency components producing high voltage alternating output 44 corresponding to an amplified version of reference signal 36. High voltage alternating output 44 supplies power to lamp load 24.

Lamp load 24 is driven by a low frequency signal to reduce emissions that could create interference with other electronic devices. The use of voltage controlled current source 32 presents a considerable weight savings over a magnetic ballast. In addition, voltage controlled current source 32 is continuously dimmable and can drive a wide variety of lamp loads 24. Magnetic ballasts and many other electronic ballast designs are not continuously dimmable and/or do not provide a universal lamp load output.

Figure 2:
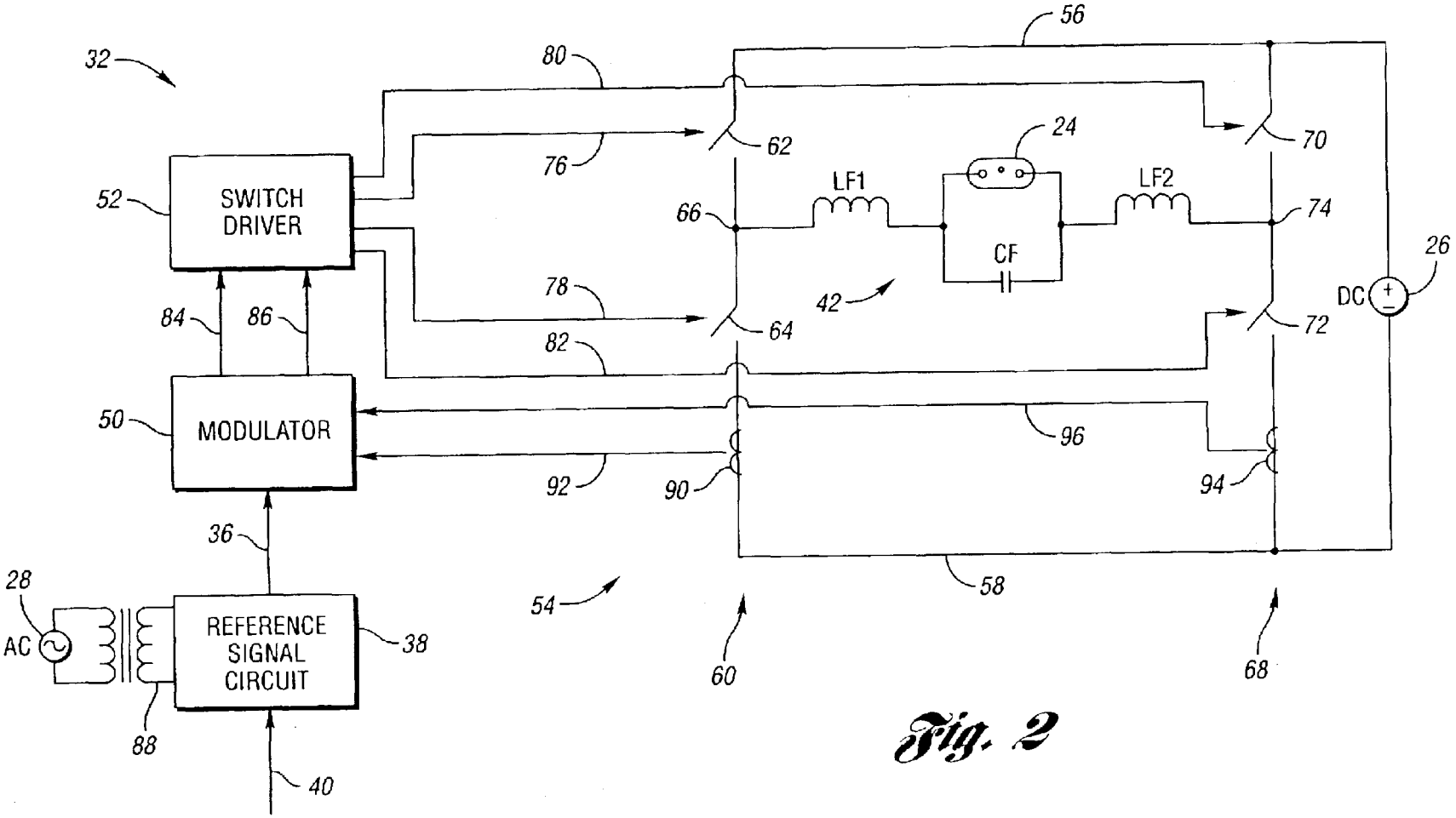
FIG. 2 is a schematic diagram illustrating a voltage controlled current source according to an embodiment of the present invention.

Referring now to FIG. 2, a schematic diagram illustrating a voltage controlled current source according to an embodiment of the present invention is shown. Voltage controlled current source 32 includes modulator 50, switch driver 52 and a switch network, shown generally by 54. Switch network 54 straddles high voltage rail 56 and low voltage rail 58 of DC power supply 26. A first leg of switch network 54, shown generally by 60, includes first switch 62 in series with second switch 64. First switch 62 and second switch 64 are joined at first output 66 of switch network 54. A second leg of the switch network, shown generally by 68, includes third switch 70 in series with fourth switch 72. Third switch 70 connects to fourth switch 72 at second output 74 of switch network 54. First switch 62, second switch 64, third switch 70 and fourth switch 72 are controlled by first switch control signal 76, second switch control signal 78, third switch control signal 80 and fourth switch control signal 82, respectively.

First network output 66 and second network output 74 are the output connections for voltage controlled current source 32. Output filter 42 interconnects outputs 66, 74 with lamp load 24. In the embodiment shown, output filter 42 includes inductor LF1 between output 66 and lamp load 24, inductor LF2 between output 74 and lamp load 24 and capacitor CF across lamp load 24.

During operation, switches 62, 64, 70, 72 are operated to generate a sequence of high frequency pulses at outputs 66, 74. These pulses are filtered by output filter 42 to remove high frequency components. During a first phase of operation, first switch 62 and fourth switch 72 are closed while second switch 64 and third switch 70 are open. This allows current to flow from first DC rail 56 through switch 62, through lamp load 24, through fourth switch 72 and into second DC rail 58. During a second phase of operation, second switch 64 and third switch 70 are closed while first switch 62 and fourth switch 72 are open. This allows current to flow from DC rail 56 through third switch 70, through lamp load 24, through second switch 64 and into second DC rail 58. By repeatedly sequencing between these two phases, an alternating current is established through lamp load 24. Changing the on times in each phase changes the magnitude and sign of current flowing through lamp load 24 since output filter 42 has a short-term averaging effect on the high frequency pulses. The switching control is adjusted so that at no time are both switches in either leg 60, 68 closed to prevent shorting high voltage DC supply 26.

Switch driver 52 generates first switch control signal 76, second switch control signal 78, third switch control signal 80 and fourth switch control signal 82 based on A-phase signal 84 and B-phase signal 86 from modulator 50. A-phase signal 84 sets the timing for the first phase when switches 62, 72 are closed and B-phase signal 86 sets the timing for the second phase when switches 64, 70 are closed. Modulator 50 determines A-phase signal 84 and B-phase signal 86 based on time varying reference signal 36. In the embodiment illustrated, reference signal 36 is generated by reference signal circuit 38 from AC supply 28 coupled through transformer 88. Dimming control input 40 varies the amplitude of line voltage derived reference signal 36.

Preferably, modulator 50 generates A-phase signal 84 and B-phase signal 86 based on feedback from switch network 54. In the embodiment shown, first current sensor 90 in first leg 60 generates first current signal 92 indicating the amount of current flowing through third switch 70, lamp load 24 and second switch 64. Second current sensor 94, in second leg 68, generates second current signal 96 indicating the amount of current flowing through first switch 62, lamp load 24 and fourth switch 72. As will be recognized by one of ordinary skill in the art, current sensors 90, 94 may be implemented in a variety of means such as current sense resistors, current sense transformers, and the like. In addition or alternatively, one or more current sensors 90, 94 may be placed within output filter 42 or in series with lamp load 24.

Figure 3:
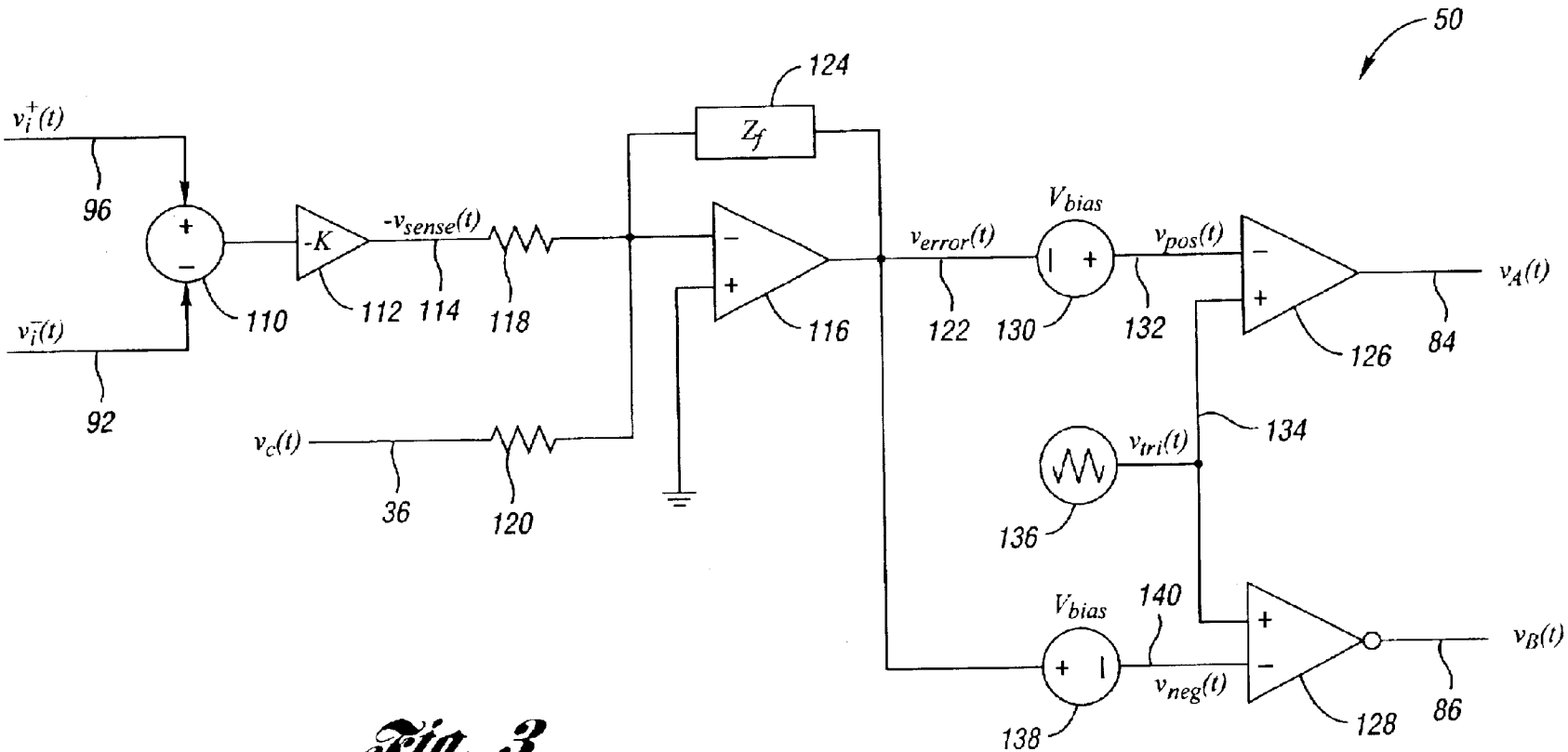
FIG. 3 is a schematic diagram illustrating a switching modulator according to an embodiment of the present invention.

Referring now to FIG. 3, a schematic diagram illustrating a switching modulator according to an embodiment of the present invention is shown. Switching modulator 50 receives reference signal 36, represented by voltage signal $v_{c(t)}$. Modulator 50 also receives first current signal 92 and second current signal 96, represented by voltage signals $v_i^-(t)$ and $v_i^+(t)$, respectively. Summer 110 outputs the difference between first current signal 92 and second current signal 96. This difference is amplified by gain block 112 to produce sense signal 114, indicated by voltage $-v_{sense}(t)$.

Amplifier 116 receives sense signal 114 through feed forward resistor 118 and reference signal 36 through feed forward resistor 120. Amplifier 116 generates error signal 122 based on the difference between the desired reference signal 36 and the sensed current signals 92, 96. Feedback impedance 124 provides a feedback path around amplifier 116 from error signal 122 to an input of amplifier 116. Feedback impedance 124 is adjusted to allow ballast 22 to operate over a wide range of lamp loads 24 while still providing acceptable dynamic performance. Selection of feedback impedance 124 for optimal performance is well known in the art of control systems.

Comparator 126 generates A-phase signal 84 based on error signal 122. Inverting output comparator 128 generates B-phase signal 86 based on error signal 122. Bias voltage 130 is added to error signal 122 to produce voltage $v_{pos}(t)$, indicated by 132. Comparator 126 compares voltage 132 with triangle voltage signal 134 from triangle voltage source 136. The output of this comparison is A-phase signal 84. Bias voltage 138 is subtracted from error signal 122 to generate voltage $v_{neg}(t)$, indicated by 140. Comparator 128 compares voltage 140 with triangle voltage signal 134 to produce B-phase signal 86.

Figure 4:
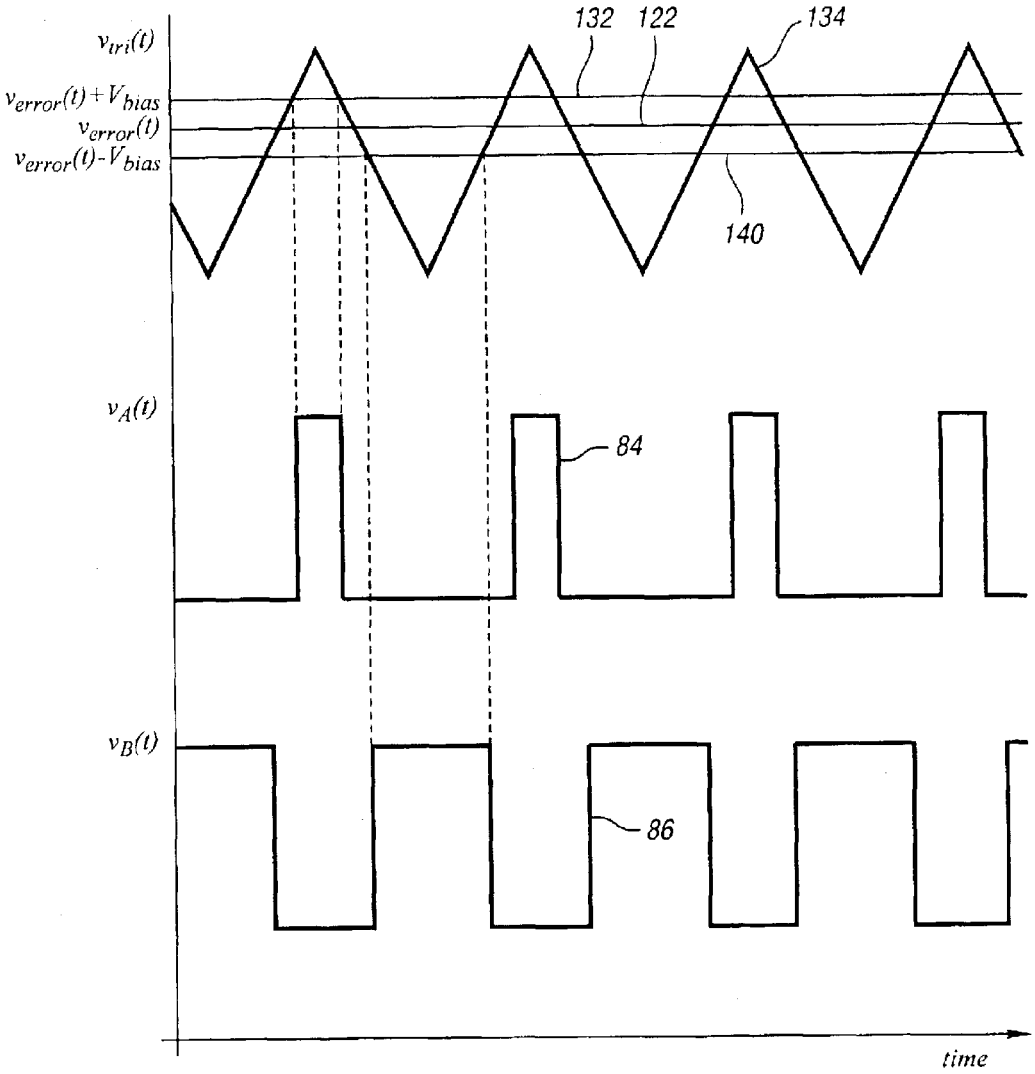
FIG. 4 is a timing diagram illustrating operation of a switching modulator according to an embodiment of the present invention.

Referring now to FIG. 4, a timing diagram illustrating operation of a switching modulator according to an embodiment of the present invention is shown. A-phase signal 84 is asserted when triangle waveform 134 exceeds the sum of error signal 122 and bias voltage 130, indicated by voltage 132. B-phase signal 86 is asserted when triangle voltage 134 falls below error signal 122 less bias voltage 138, indicated by 140. The use of bias voltages 130, 138 provides a period of dead time between when A-phase signal 84 and B-phase signal 86 are asserted. This prevents both switches in either leg 60, 68 of switching network 56 from being closed at the same time.

During normal operation of ballast 22, changes in time varying reference signal 36 creates an increase in the magnitude of error signal 122. This generates a difference in the pulse widths between A-phase signal 84 and B-phase signal 86. These differences, in turn, affect the current flow through lamp load 24. Output filter 42 is adjusted such that the current through lamp load 24 reflects reference signal 36 by removing high frequency components generated by the pulse trains in A-phase signal 84 and B-phase signal 86.

A striking operation is used to ignite most arc discharge lamp loads 24. Some types of arc discharge lamp loads 24 require or exhibit improved performance when preheated. A preheat circuit, not shown, supplies current to each filament of lamp load 24 while high voltage is disabled. Once preheat is occurred, command signal 36 is applied. Before striking, no current flows through current sensors 90, 94. This maximizes error signal 122, resulting in a rapidly applied, relatively large high voltage signal across lamp load 24. This large voltage is ideal for striking lamp load 24. Striking may be assisted by commanding a constant value for reference signal 36 during striking.

Referring now to FIGS. 5*a*–5*f*, circuit diagrams illustrating an electronic ballast according to an embodiment of the present invention are shown. The exemplary design satisfies requirements for the T8 family of fluorescent lamps. In particular, the design operates with a minimum load of one T8, 9 W fluorescent lamp and a maximum load of two T8, 32 W fluorescent lamps. As will be recognized by one of ordinary skill in the art, this design may be readily modified for a wide variety of other lamp types including T12, T5, T2, compact fluorescent, HID, and the like. The exemplary design operates from 400 Hz aircraft line power at 115 VAC±10%. In addition, the design is intended to meet EMI requirements as specified in DO-160 C or D. As will be recognized by one of ordinary skill in the art, this design may be readily adapted to a wide variety of input power supplies and noise specifications.

An AC input circuit, shown generally by 150, accepts power from AC supply 28 through AC hot line 152 and AC neutral line 154. Differential mode inductor, L2, is used in conjunction with capacitor C27 to implement a low pass filter suppressing differential mode conducted RF emissions. The winding of inductor L2 is split into two halves and wound on physically separate bobbin sections. This creates leakage inductance that functions to provide common mode filtering. The LC filter pole is set to suppress frequencies above 4.1 kHz. Capacitors C25 and C28 work in conjunction with capacitor C27 to steer common mode conducted emissions back to the source and away from ballast 22. These common mode emissions are converted to differential mode emissions across C27 and are then blocked by the high leakage inductance impedance presented by inductor L2. Full wave rectifier bridge 156 receives the sinusoidal filtered power input and produces rectified sine wave 158.

Figure 5:
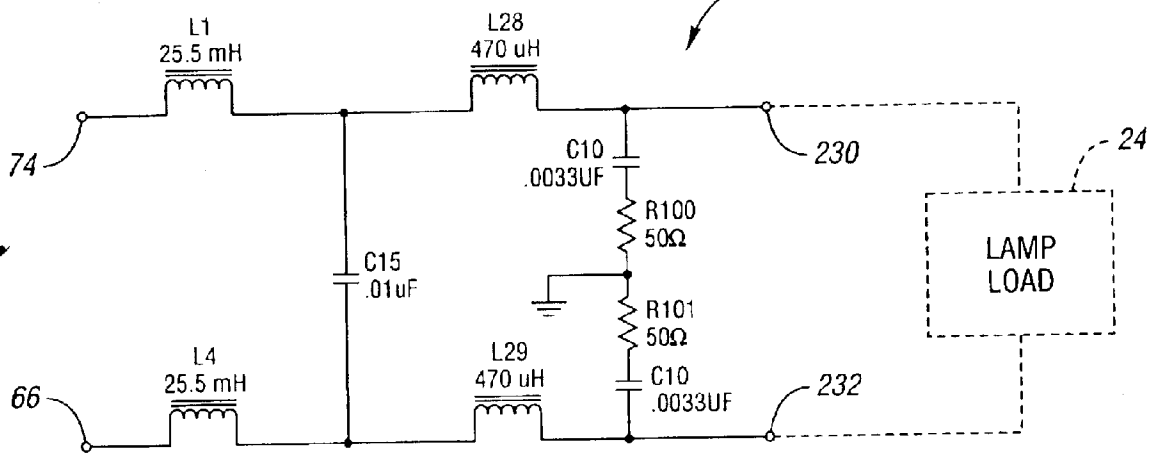
FIGS. 5*a*–5*f* are circuit diagrams illustrating an electronic ballast according to an embodiment of the present invention.
Figure 5A:
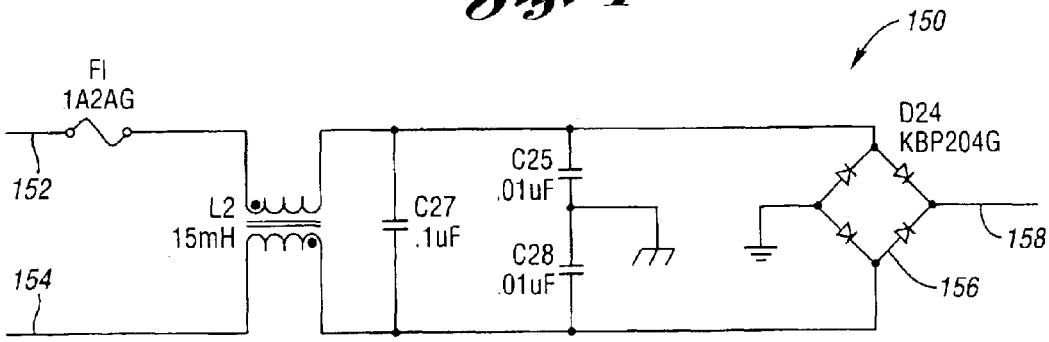
Figure 5B:
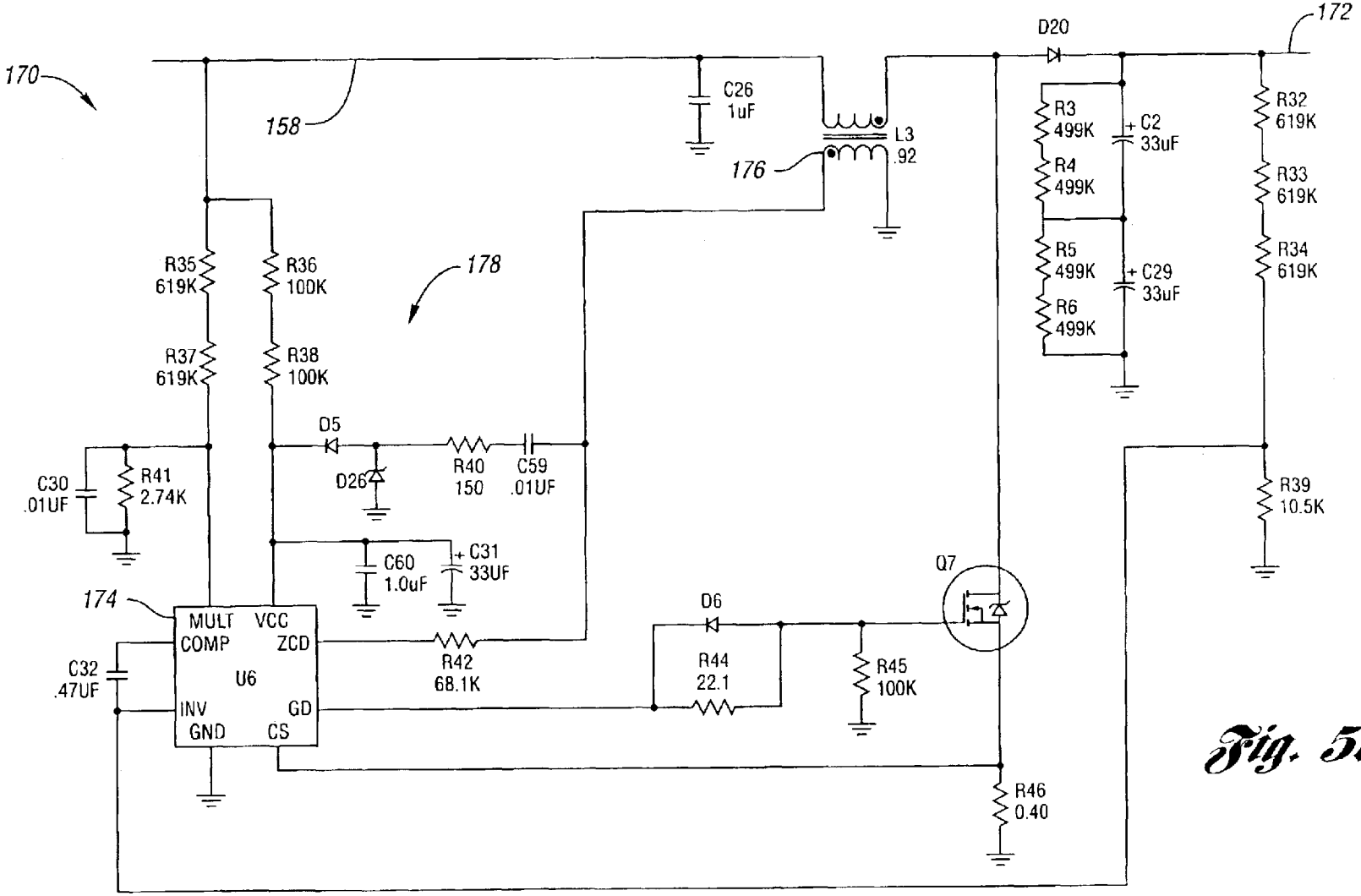

A voltage boost and power factor correction circuit, shown generally by 170 in FIG. 5*b*, accepts rectified sine wave 158 and generates boosted, regulated voltage 172 at 400 VDC. The boost converter illustrated includes boost inductor L3, controlled power switch Q7, catch diode D20, output capacitance formed by capacitors C2 and C29, and control circuitry. Circuit 170 provides power factor correction by shaping input current to be in-phase with the input sinusoidal voltage. This is accomplished through control logic 174 embodied in an L6561 Enhanced Transition Mode Power Factor Corrector from STMicroelectronics. Application of this integrated circuit chip is well known in the art and is described, for example, in application note AN966 from STMicroelectronics.

Resistors R32, R33, R34 and R39 form a voltage divider measuring the constant output voltage 172. Capacitor C32 provides frequency compensation to prevent controller 174 from over responding to any high frequency ripple on output 172. Auxiliary winding 176 on boost inductor L3 senses current flow from rectified sine wave 158. Voltage regulator and under voltage lockout circuitry 178 supports voltage regulation and protects against under voltage from rectified sine wave 158. Current sense resistor R46 senses the current through switching transistor Q7.

Figure 5C:
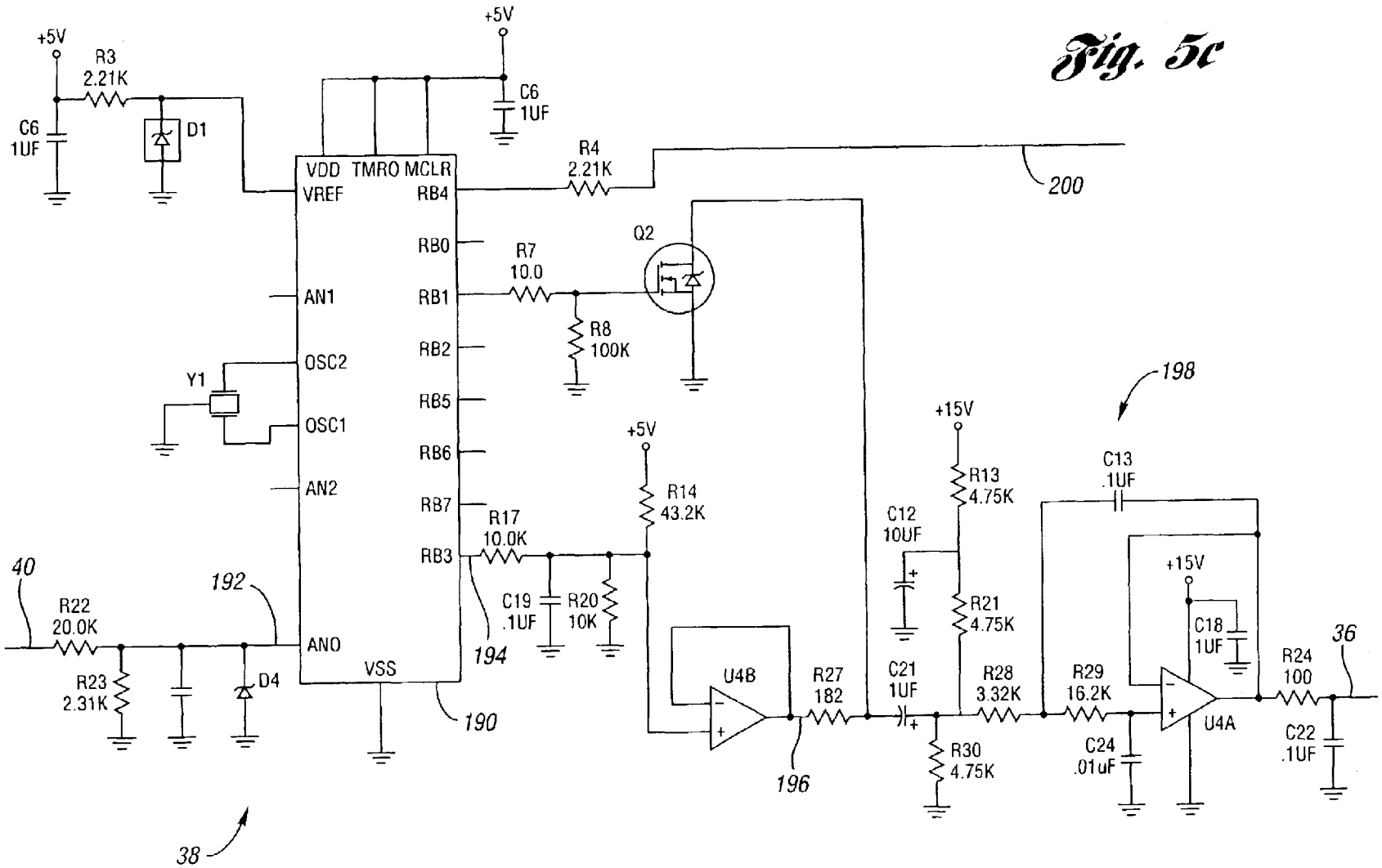
Figure 5B:
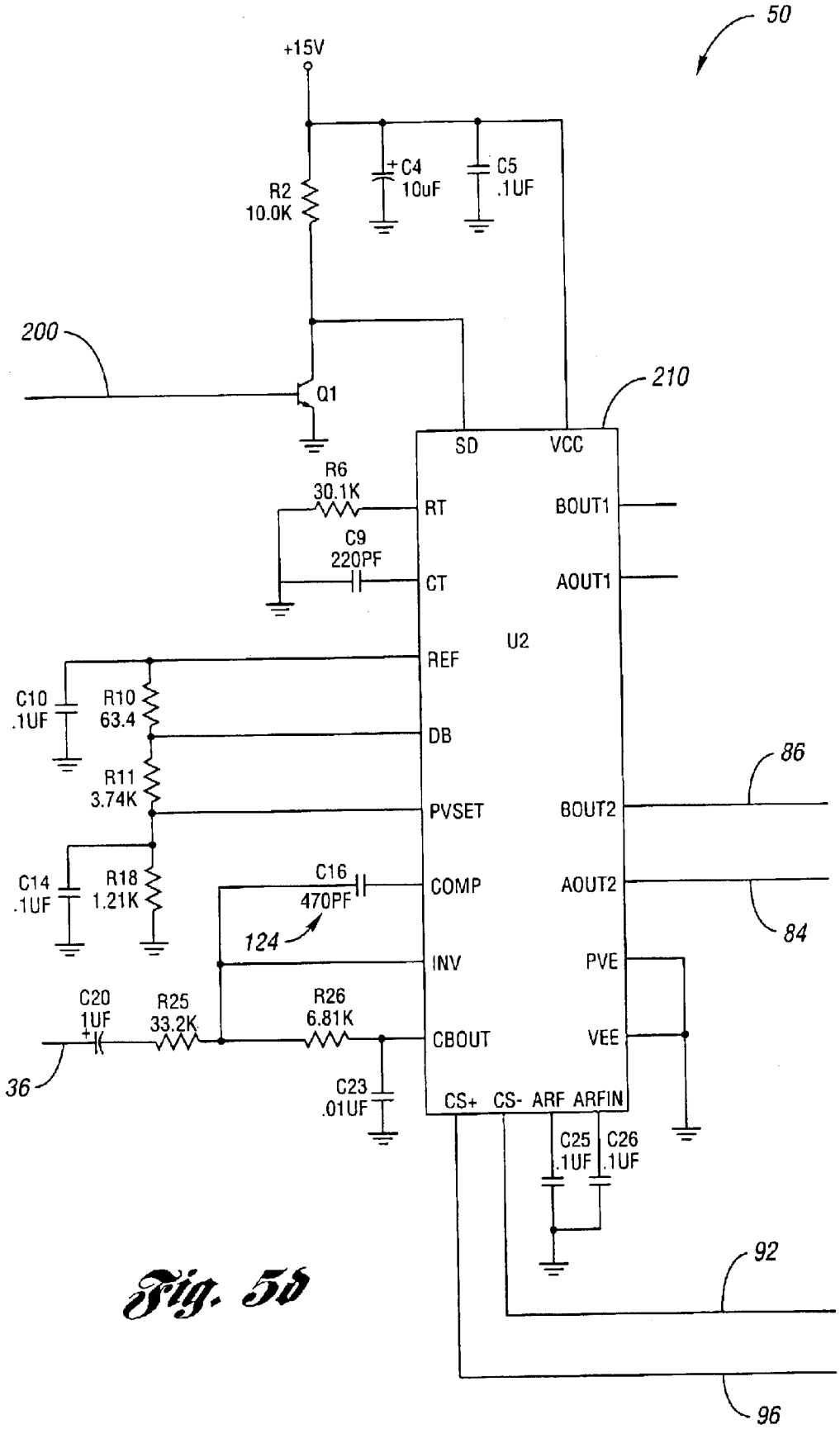
Figure 5C:
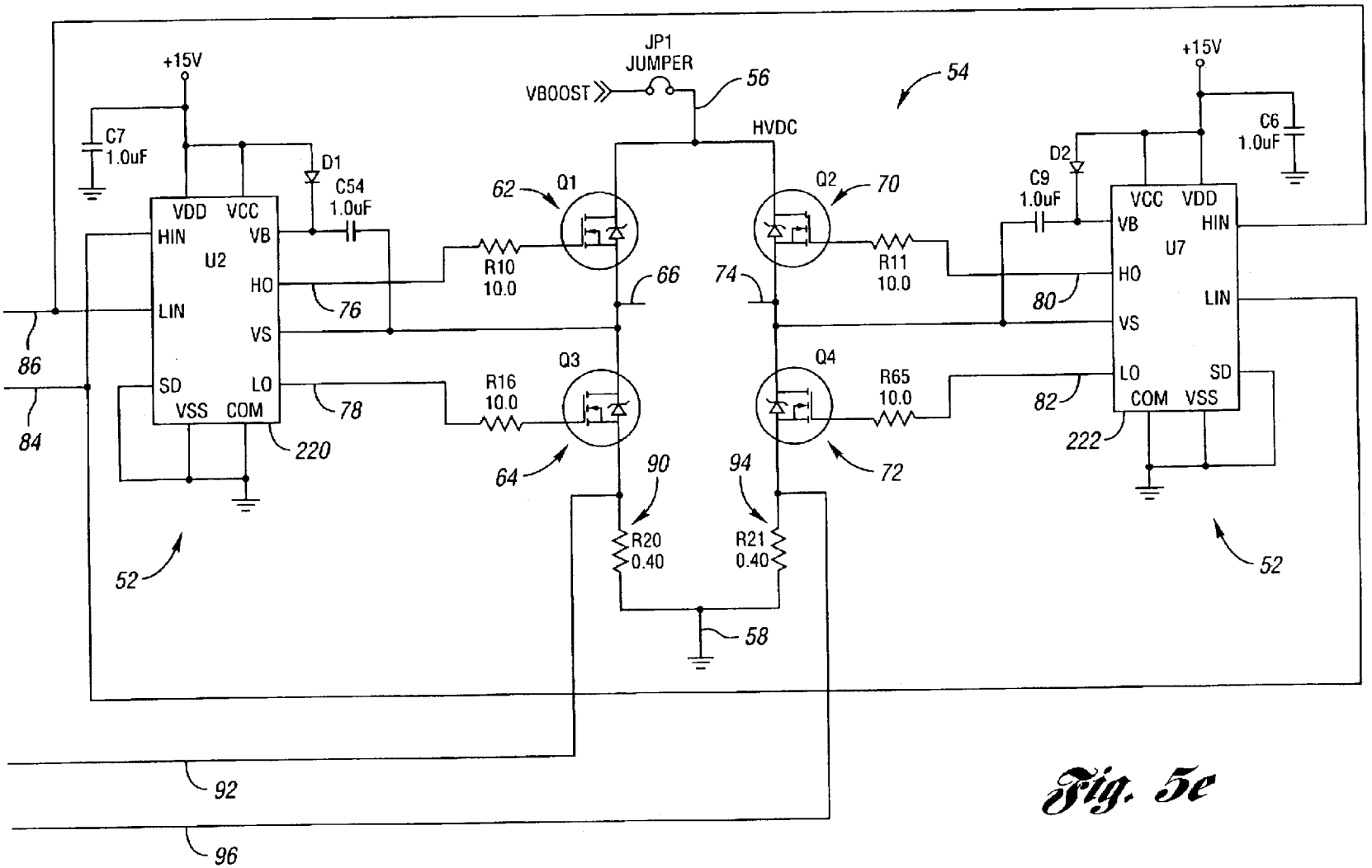

An exemplary reference signal circuit 38 is illustrated in FIG. 5C. Reference circuit 38 includes microcontroller 190 such as the PIC16C712 from Microchip Technology Inc. Reference signal circuit 38 receives dimming input 40 as a voltage signal sensed by an analogue-to-digital converter within microcontroller 190. In the embodiment shown, reference signal circuit 38 generates reference signal 36 as a sinusoidal voltage having an amplitude based on dimming input 40.

Output 194 of microcontroller 190 is programmed to generate a high frequency pulse modulated waveform which is filtered by a low pass filter formed by R17 and C19 to produce a rectangular waveform at 400 Hz having a duty cycle proportional to dimming input 40. Resistors R14 and R20 provide a DC bias, permitting the use of single-sided op amps. As will be recognized by one of ordinary skill in the art, any arbitrary, low frequency waveform can be generated at point 196 by outputting the appropriate high frequency pulse width modulated signal at 194. A second low pass filter, indicated by 198, further removes higher order components generating a sinusoidal signal as reference signal 36.

Generating reference signal 36 independent of AC supply 28 carries several advantages. First, reference signal 36 may have a different frequency and waveform than provided by AC supply 28. Second, reference signal 36 is free from anomalies that may appear on the input power lines. These anomalies are introduced by other loads connected to AC supply 28, EMI received on power lines, and the like.

Reference signal 36 may contain a time varying signal riding on a small DC offset. This may prolong the life of lamp load 24. As will be recognized by one of ordinary skill in the art, reference circuit 38 may be readily modified to provide a DC offset for reference signal 36.

Microcontroller 190 can control generation of reference signal 36 by turning on transistor Q2, which pulls point 196 to ground. Microcontroller 190 is also programmed to generate shut down signal 200 halting operation of modulator 50. Asserting shut down signal 200 inhibits current from reaching the lamp load 24.

As will be recognized by one of ordinary skill in the art, any type of signal generator 38 may be used in the present invention. Furthermore, any time varying waveform may be used as reference signal 36, including square waves, triangular waves, sawtooth waves, aperiodic waves, and the like. Preferably, reference signal 36 should have a small lamp load crest factor, such as is provided by a square wave.

An exemplary modulator circuit 50 is illustrated in FIG. 5*d*. Modulator 50 includes modulator controller 210 implemented in this example embodiment with a UC2638DW Advanced PWM Motor Controller from Unitrode Products, a division of Texas Instruments, Inc. Modulator 50 generates A-phase signal 84 and B-phase signal 86 based on dimming input 40, first current signal 92 and second current signal 96. Resistor R26 and capacitor C23 form a high frequency noise filter for dimming input 40. Capacitor C16 comprises feedback impedance 124 to set compensation, control lamp load crest factor and set DC gain. Resistors R10, R11 and R18 adjust the dead band between pulses in A-phase signal 84 and B-phase signal 86. Capacitor C9 and resistor R6 set the frequency of triangle signal 134 which, in turn, determines the frequency of pulses in A-phase signal 84 and B-phase signal 86. A value of 30.1 kΩ for R6 and 220 pF for capacitor C9 results in a frequency of 30 kHz. Shut down signal 200 drives the base of transistor Q1. If shut down signal 200 is high, all driver outputs on modulator controller 210 are disabled.

An exemplary switch driver 52 and switch network 54 are illustrated in FIG. 5*e*. Switch network 54 is implemented with four FETs Q1, Q3, Q2 and Q4 implementing first switch 62, second switch 64, third switch 70 and fourth switch 72, respectively. First current sensor 90 is implemented with resistor R20 generating a voltage proportional to the current flowing through second switch 64 as first current signal 92. Similarly, second current sensor 94 is implemented with resistor R21 generating a voltage proportional to the current through fourth switch 72 as second current signal 96.

Switch driver 52 is implemented with first side driver 220 and second side driver 222, each of which includes an IR2113S High and Low Side Driver from International Rectifier. Each driver 220, 222 receives A-phase signal 84 and B-phase signal 86. First side driver 220 generates first switch control signal 76 and second switch control signal 78 for first switch 62 and second switch 64, respectively. Second side driver 222 generates third switch control signal 80 and fourth switch control signal 82 for third switch 70 and fourth switch 72, respectively.

An exemplary embodiment of output filter 42 is illustrated in FIG. 5*f*. Output filter 42 connects to switching network 54 at first output 66 and second output 74. Lamp load 24 connects to output filter 42 at first filter output 230 and second filter output 232. Output filter 42 removes components resulting from the high frequency switching pulses received on A-phase signal 84 and B-phase signal 86. Output filter 42 passes components resulting from low frequency reference signal 36. In the embodiment shown, output filter 42 implements a low pass filter with a cutoff frequency between the frequency of alternating reference signal 36 and the high frequency pulses in A-phase signal 84 and B-phase signal 86.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electronic ballast for powering an arc discharge lamp load comprising:

a power supply generating a high voltage DC signal;

a low frequency time varying reference signal;

a high voltage, AC voltage controlled current source generating a high frequency, high voltage substantially rectangular signal at a source output by switching the high voltage DC signal based on the low frequency time varying reference signal, the current source comprising a bridge switching circuit with a first leg and a second leg, each leg including two switches in series, at least one current sensor generating current signals proportional to the current in the first leg and the second leg, and a pulse width modulator generating switching signals for each switch in the bridge based on the reference signal and the current signals; and a low pass filter connecting between the first leg and the second leg at a point on each leg between the switches on that leg, the low pass filter having a cutoff frequency between the high frequency and the low frequency, the low pass filter outputting high voltage at the low frequency for driving the arc discharge lamp load.

2. The electronic ballast for powering an arc discharge lamp load as in claim 1 wherein the pulse width modulator generated switching signals switch the high voltage DC signal through a first switch in the first leg, the lamp load and a second switch in the second leg during a first switching phase and switch the high voltage DC signal through a first switch in the second leg, the lamp load and a second switch in the first leg during a second switching phase.

3. The electronic ballast for powering an arc discharge lamp load as in claim 1 wherein the low pass filter comprises at least one inductive element between the lamp load and the first leg and at least one inductive element between the lamp load and the second leg.

4. The electronic ballast for powering an arc discharge lamp load as in claim 1 wherein variations in amplitude of the low frequency time varying reference signal cause corresponding variations in light intensity of the lamp load.

5. The electronic ballast for powering an arc discharge lamp load as in claim 1 further comprising a signal generator generating the low frequency time varying reference signal.

6. The electronic ballast for powering an arc discharge lamp load as in claim 1 wherein the power supply generating a high voltage DC signal generates the DC signal from alternating line power and wherein the low frequency time varying reference signal is based on the alternating line power.

7. The electronic ballast for powering an arc discharge lamp load as in claim 1 wherein the low frequency time varying reference signal modulates a high frequency switching signal to generate the high frequency, high voltage substantially rectangular signal.

8. The electronic ballast for powering an arc discharge lamp load as in claim 1 wherein the pulse width modulator comprises an error amplifier amplifying a difference between the current signals and the reference signal, the error amplifier comprising compensating feedback.

9. The electronic ballast for powering an arc discharge lamp load as in claim 8 wherein the difference between the current signals and the reference signal results in a high voltage striking signal during lamp load striking.

10. A method for powering an arc discharge lamp load comprising:

generating a high voltage DC signal;

receiving a low frequency alternating reference signal;

generating a high frequency switching signal modulated by the low frequency alternating reference signal;

connecting a switching H-bridge between rails of the generated high voltage DC signal, the H-bridge comprising a first switching element in series with a second switching element in a first leg and a third switching element in series with a fourth switching element in a second leg, the arc discharge lamp load connected between the first switching element and the second switching element on the first leg and between the third switching element and the fourth switching element on the second leg;

switching on the first switching element and the fourth switching element while the second switching element and the third switching element are switched off such that current flows through the first switching element, the arc discharge lamp load and the fourth switching element;

switching on the second switching element and the third switching element while the first switching element and the fourth switching element are switched off such that current flows through the second switching element, the arc discharge lamp load and the third switching element;

whereby the high voltage DC signal is switched using the high frequency switching signal, the switched high voltage DC signal thereby having components introduced by the high frequency switching signal and components introduced by the low frequency alternating reference signal;

generating an output signal by attenuating components of the switched high voltage DC signal introduced by the high frequency switching signal without substantially attenuating components of the switched high voltage DC signal introduced by the low frequency alternating reference signal; and supplying the output signal to the arc discharge lamp load.

11. The method for powering an arc discharge lamp load as in claim 10 further comprising varying intensity of emission by the arc discharge lamp load through varying at least one parameter of the low frequency alternating reference signal.

12. The method for powering an arc discharge lamp load as in claim 10 wherein the low frequency alternating reference signal is generated by a signal generator.

13. The method for powering an arc discharge lamp load as in claim 10 wherein the high voltage DC signal is generated from an alternating line voltage and wherein the low frequency alternating reference signal is based on the alternating line voltage.

14. The method for powering an arc discharge lamp load as in claim 10 further comprising sensing the current flowing through the second switching element and sensing the current flowing through the fourth switching element.

15. The method for powering an arc discharge lamp load as in claim 14 further comprising generating the high frequency switching signal based on the sensed current flowing through the second switching element and on the sensed current flowing through the fourth switching element.

16. The method for powering an arc discharge lamp load as in claim 14 further comprising generating a striking signal based on the sensed current flowing through the second switching element and on the sensed current flowing through the fourth switching element.

17. A lighting system comprising:

a DC source providing DC power through a first DC connection and a second DC connection;

a first switching element connected between the first DC connection and a first bridge output;

a second switching element connected between the first bridge output and the second DC connection;

a third switching element connected between the first DC connection and a second bridge output;

a fourth switching element connected between the second bridge output and the second DC connection;

a low frequency reference signal;

a controller receiving the low frequency reference signal, the controller generating control signals for the first switching element, the second switching element, the third switching element and the fourth switching element, the control signals including high frequency switching pulses modulated by the low frequency reference signal;

a four port output filter having two input ports and two output ports, a first input port connected to the first bridge output and a second input port connected to the second bridge output, the output filter removing components resulting from the high frequency switching pulses while passing components resulting from the low frequency reference signal; and at least one arc discharge lamp connected to the output filter output ports.

18. The lighting system as in claim 17 wherein the intensity of light emitted by the at least one arc discharge lamp is modified by modifying at least one parameter of the low frequency reference signal.

19. The lighting system as in claim 17 further comprising:

a first current sensor in series with the first switching element and the second switching element, the first current sensor generating a first current signal;

a second current sensor in series with the third switching element and the fourth switching element, the second current sensor generating a second current signal;

an error amplifier generating an error signal based on a difference between the low frequency reference signal and a combination of the first current signal and the second current signal; and a compensating network connected in feedback around the error amplifier.

20. An electronic ballast for powering an arc discharge lamp load comprising:

a power supply generating a high voltage DC signal, the power supply generating the DC signal from alternating line power;

a low frequency time varying reference signal based on the alternating line power;

a high voltage, AC voltage controlled current source generating a high frequency, high voltage substantially rectangular signal at a source output by switching the high voltage DC signal based on the low frequency time varying reference signal; and a low pass filter interconnecting the source output and the lamp load, the low pass filter having a cutoff frequency between the high frequency and the low frequency, the low pass filter outputting high voltage at the low frequency for driving the arc discharge lamp load.

21. The method for powering an arc discharge lamp load comprising:

generating a high voltage DC signal from an alternating line voltage;

receiving a low frequency alternating reference signal based on the alternating line voltage;

generating a high frequency switching signal modulated by the low frequency alternating reference signal;

switching the high voltage DC signal using the high frequency switching signal, the switched high voltage DC signal thereby having components introduced by the high frequency switching signal and components introduced by the low frequency alternating reference signal;

generating an output signal by attenuating components of the switched high voltage DC signal introduced by the high frequency switching signal without substantially attenuating components of the switched high voltage DC signal introduced by the low frequency alternating reference signal; and supplying the output signal to the arc discharge lamp load.

* * * * *